US006951329B2

(12) United States Patent
Musk et al.

(10) Patent No.: US 6,951,329 B2
(45) Date of Patent: Oct. 4, 2005

(54) CONCRETE WALL FORM WITH FLEXIBLE TIE SYSTEM

(75) Inventors: Randy J. Musk, Schaumburg, IL (US); Edward Rahe, Winfield, IL (US)

(73) Assignee: Symons Corporation, Des Plaines, IL (US)

( * ) Notice: Subject to any disclaimer, the term of this patent is extended or adjusted under 35 U.S.C. 154(b) by 0 days.

(21) Appl. No.: 10/337,625

(22) Filed: Jan. 7, 2003

(65) Prior Publication Data

US 2004/0129857 A1 Jul. 8, 2004

(51) Int. Cl.[7] ..... E04G 17/06
(52) U.S. Cl. ..... 249/190; 249/43
(58) Field of Search ..... 249/43, 40, 190, 249/213

(56) References Cited

U.S. PATENT DOCUMENTS

| | | | | |
|---|---|---|---|---|
| 2,503,494 A | | 4/1950 | Keith | 25/131 |
| 2,529,648 A | | 11/1950 | Borton | 25/131 |
| 2,948,045 A | | 8/1960 | Imonetti | 25/131 |
| 3,181,832 A | | 5/1965 | Chianese | 249/43 |
| 3,730,476 A | * | 5/1973 | Prichard, Jr. | 249/191 |
| 3,981,476 A | | 9/1976 | Alexander et al. | 249/42 |
| 4,030,694 A | | 6/1977 | Schimmel | 249/196 |
| 4,033,544 A | | 7/1977 | Johnston | 249/40 |
| 4,044,987 A | | 8/1977 | Tausanovitch et al. | 249/219 W |
| 4,052,032 A | | 10/1977 | Lovisa et al. | 249/40 |
| 4,350,318 A | | 9/1982 | Gallis | 249/40 |
| 4,880,204 A | | 11/1989 | Steele | 249/219.2 |
| 5,137,250 A | | 8/1992 | McCracken | 249/40 |
| 5,651,910 A | * | 7/1997 | Myers et al. | 249/41 |
| 5,836,126 A | | 11/1998 | Harkenrider et al. | 52/410 |
| 5,861,105 A | * | 1/1999 | Martineau | 249/44 |
| 6,024,339 A | | 2/2000 | Gates | 249/45 |
| 2001/0028024 A1 | | 10/2001 | Carlson | 249/191 |

OTHER PUBLICATIONS

Symons, *Alisply*™, Brochure, 8 pp., ©2001, U.S.A.
Symons, *Steel–Ply®Forming System*, Brochure, 28 pp., ©2001, U.S.A.

* cited by examiner

*Primary Examiner*—Michael Safavi
(74) *Attorney, Agent, or Firm*—Wood, Herron & Evans L.L.P.

(57) ABSTRACT

A concrete wall form that can readily be used with different types of form ties systems to construct parallel form sections for receiving poured concrete. The form includes first and second tie rod engaging portions configured to receive first and second types of tie rods, respectively. In one aspect of the invention, the first tie rod engaging portion is configured to receive frangible tie rods in the form of elongate wires or flat strips. In another aspect of the invention, the second tie rod engaging portion is configured to receive tie rods having threaded bars that extend through tubes and between parallel wall form sections.

8 Claims, 2 Drawing Sheets

CONCRETE WALL FORM WITH FLEXIBLE TIE SYSTEM

FIELD OF THE INVENTION

This present invention pertains to apparatus for forming concrete structures, and more particularly to concrete wall forms.

BACKGROUND OF THE INVENTION

Concrete wall forms are well known in the art and generally comprise a series of form sections which may be joined together in an edge-to-edge relationship and arranged in a spaced, parallel arrangement with respect to a second series of form sections to define a space for receiving poured wet concrete therebetween. One particular type of wall form shown and described herein, comprises a composite form having a metal frame and a planar facing member secured to the frame. The frame may be of steel or aluminum and the facing member generally comprises a laminated plywood panel sized to fit the frame. Examples of this type of form have been manufactured and sold by Symons Corporation of Des Plaines, Ill. under the trademarks STEEL-PLY® and ALISPLY™. Because these forms are relatively light in weight, they are particularly suited to use where the forms are handled manually, such as in the construction of residential structures for example.

In use, the spaced parallel form sections are maintained in their proper relationship by tie rods which span the space between the parallel form sections and are secured to the oppositely facing forms. One type of tie system commonly used in the United States utilizes frangible tie rods formed from metal wire or flat metal strips, such as those disclosed in U.S. Pat. Nos. 2,580,330 and 2,948,045, assigned to the assignee of the present invention and incorporated herein by reference in their entirety. These frangible ties generally have reduced portions along their length that define opposed ends which may be broken off and removed from the cured concrete structure while a central portion of the tie remains embedded therein. A different type of tie system, which is popular in European countries, as well as in Canada and South America, utilizes a threaded bar which extends between the parallel form sections. The threaded bar may be secured to the respective forms by a nut tightened over the threaded bar. The bar passes through a tube, generally formed from PVC, and the tube protects the threaded rod from contact with the poured concrete. After the concrete has cured, the tube remains embedded in the concrete structure but the bar may be removed for subsequent use.

While both types of tie systems have been used for many years, prior concrete forms are generally configured to utilize only one type or the other. Accordingly, contractors or builders are limited to using the tie system to which their forms have been manufactured for use. Therefore, if it is desired to utilize a different tie system, either because of customer requirements or otherwise, the forms must be significantly modified or else new forms purchased to accommodate the desired tie system.

There is thus a need for a concrete form which is capable of utilizing various form tie systems.

SUMMARY OF THE INVENTION

The present invention provides a concrete wall form that can be used with different types of form tie systems to mold concrete wall structures. The form has a frame that supports a facing member which defines an interface barrier with poured concrete. Series of forms may be arranged edge-to-edge and placed in a spaced, parallel arrangement with an oppositely facing series of forms to define a space for receiving poured concrete. The ties extend between the oppositely facing forms to maintain a spacing which corresponds to a desired wall thickness.

The form includes a first tie rod engaging portion that is configured to receive a first type of tie rod, and a second tie rod engaging portion that is configured to receive a second type of tie rod. In one aspect of the invention, the first tie rod engagement portion comprises a series of notches formed into the frame. When several forms are assembled together, corresponding notches on adjacent forms register with one another to define apertures through which tie rods of the first type may be inserted to extend between oppositely facing forms. Thereafter, the ends of the tie rods are secured to the respective forms to fix the forms in position. In an exemplary embodiment, the first type of tie rod is in the form of an elongate wire or a flat strip of material, typical of the tie rods commonly used in the United States.

In another aspect of the invention, the second tie rod engaging portion comprises a plate attached to the frame near the first tie rod engagement portion and is used in conjunction with a bracket that is coupled to the frame to support the second type of tie rod. In an exemplary embodiment, the second type of tie rod includes a threaded bar which extends between parallel forms and which is typical of tie rods commonly used in Europe, Canada, and South America. Accordingly, the plate and bracket each have apertures sized to receive the threaded bar. The concrete wall form of the present invention may thus be used with the first type of tie rods, as described above, and when it is desired to use the second type of tie rod, brackets are easily coupled to the form for use in conjunction with the plates to support the second type of tie rod.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
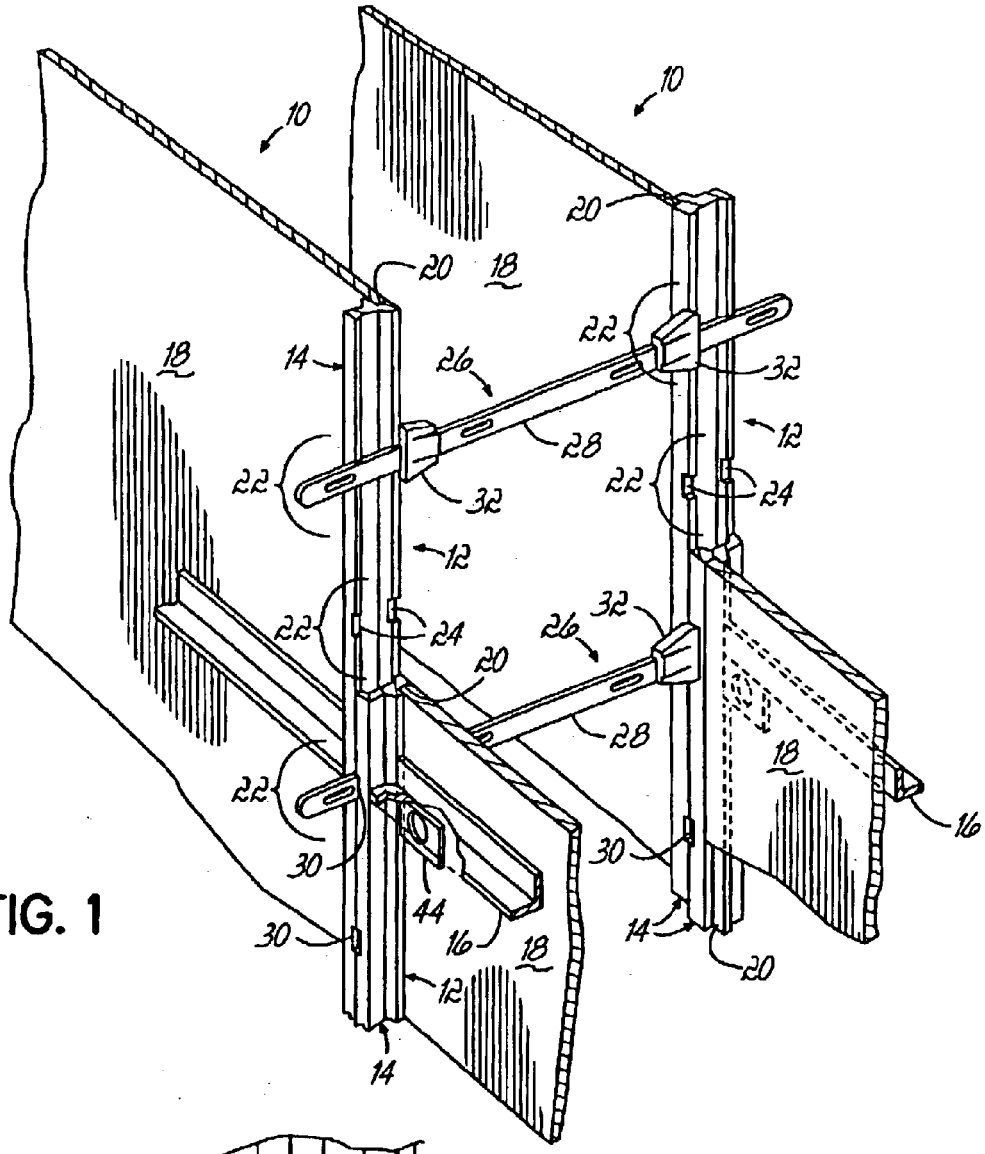
FIG. 1 is a perspective view of an exemplary concrete form of the present invention being used with a first type of tie system.

Referring to FIG. 1, there are shown portions of exemplary concrete forms 10 of the present invention arranged edge-to-edge and also in a spaced, confronting arrangement with respect to a second group of edge aligned exemplary concrete forms 10 to define a space for receiving poured concrete, as known in the art and described, for example, in U.S. Pat. No. 2,948,045. The exemplary forms 10 comprise a frame 12 including vertical and horizontal marginal frame members 14 defining a rectangular structure, and horizontal and/or vertical reinforcing members 16 extending between the marginal frame members, as shown and described in U.S. Pat. Nos. 2,948,045 and 4,030,694 and incorporated herein by reference in their entirety. In the partial view illustrated in FIG. 1, only the vertical marginal frame members 14 and horizontal reinforcing members 16 are visible. The form 10 further includes a facing member 18 secured to the frame 12 to define an interface for molding the poured concrete. In the exemplary embodiment shown, the marginal frame members 14 are formed with a recess 20 for receiving the facing member 18 such that a surface of the facing member that contacts the poured concrete is flush with edge surfaces of the marginal framing members 14.

The marginal framing members 14 further include first tie rod engaging portions 22 configured to receive tie rods 26 of the type commonly used in the United States, as described above. In the exemplary embodiment shown, the first tie rod engaging portions 22 comprise a series of notches 24 formed into the outer perimeter of the marginal framing members 14 and sized to receive frangible ties 28 of the first type of tie rod 26. When the forms 10 are arranged edge-to-edge, notches 24 in adjacent marginal frame members 14 are in registration with one another, whereby the ties 28 may be inserted through an aperture 30 defined by adjacent notches 24 to extend between parallel form sections, as described more fully in U.S. Pat. No. 2,948,045. As depicted in FIG. 1, the tie rods 26 may include cone-shaped devices 32 which help to prevent shifting of the ties 28 inserted between the form sections 10 and also facilitate removal of the breakable ends of the tie rod 26 after the concrete has cured and the form sections 10 have been removed.

Figure 3:
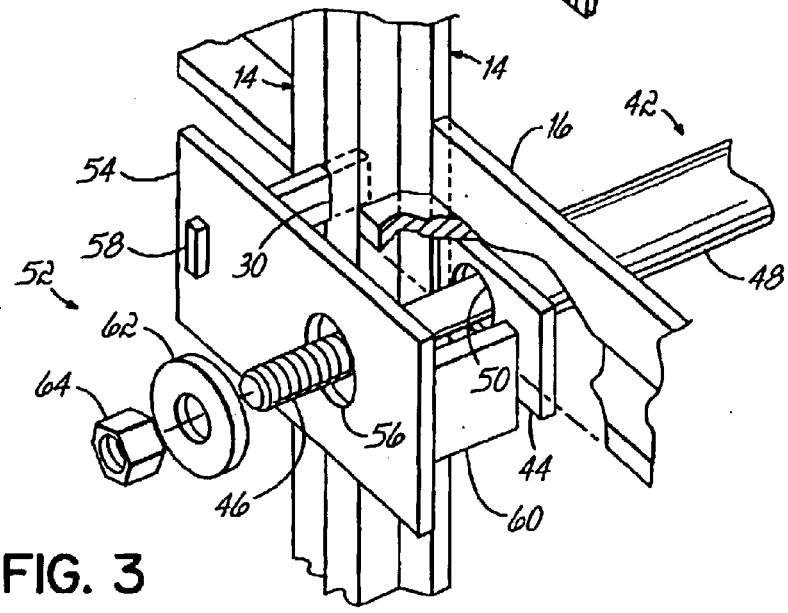
FIG. 3 is a perspective view illustrating details of the concrete form of the present invention.
Figure 1A:
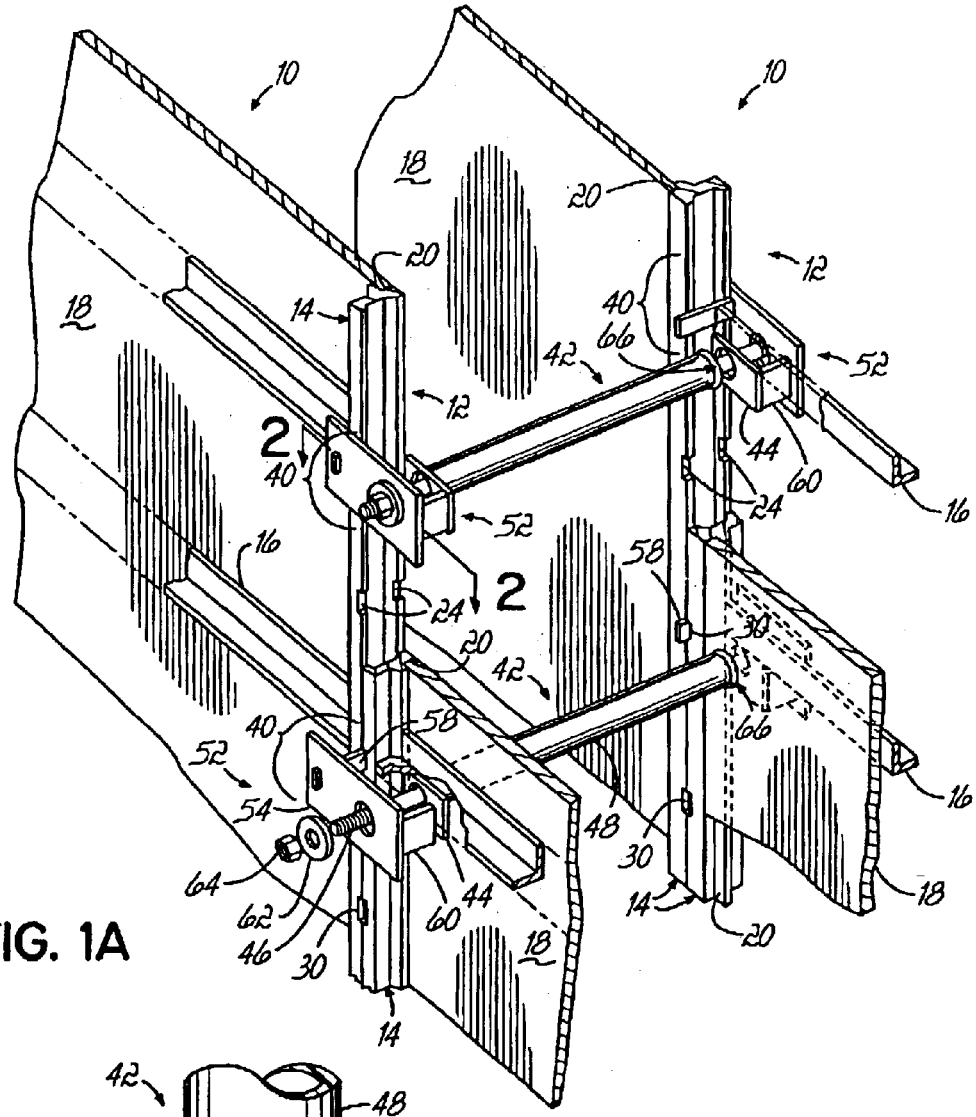
FIG. 1A is a perspective view of the concrete form of FIG. 1, utilizing a second type of tie system.
Figure 2:
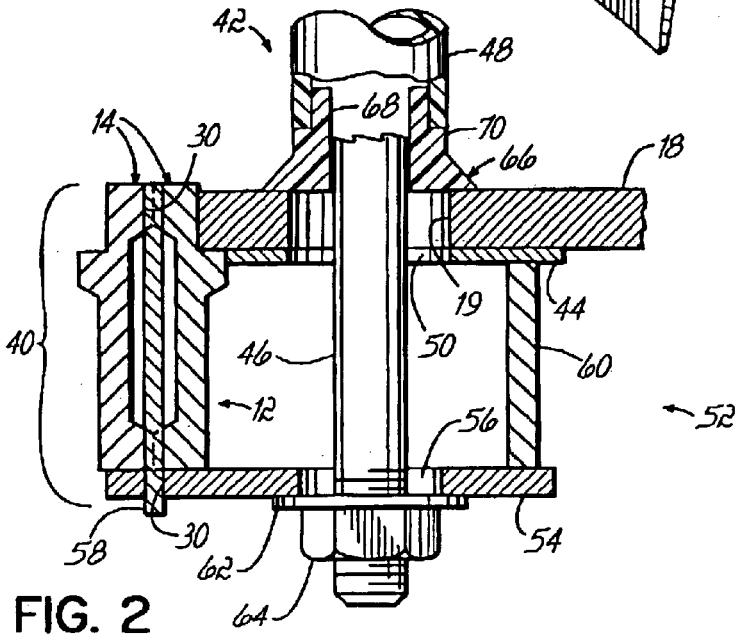
FIG. 2 is a partial cross section of the form system of FIG. 1A, taken along lines 2—2.

Referring now to FIGS. 1A, 2, and 3, the concrete forms 10 of the present invention are shown with a second type of tie rod installed between parallel form sections 10. As seen in this embodiment, the concrete form 10 of the present invention further includes second tie rod engaging portions 40 configured to receive a second type of tie rod 42, to enable the form 10 to be used with an alternative tie system. In the exemplary embodiment shown, the second tie rod engagement portions 40 comprise plates 44 attached to the frame 12 near the notches 24 of the first tie rod engagement portions 22. The plates 44 may be welded to the frame 12 at the intersection of vertical marginal frame members 14 and horizontal reinforcing members 16, or may be fixed to the frame 12 by other attachment methods, or alternatively, formed integrally with the frame 12.

In the exemplary embodiment, this second type of tie system 42 includes a threaded rod 46 which extends between oppositely facing form sections 10 through a tube 48 which is disposed between the parallel form sections 10. The threaded rod 46 extends through an opening 19 (see FIG. 2) in facing member 18 and an aperture 50 formed in the plate 44 attached to the frame 12, and tube 48 abuts the facing member 18 such that it is clamped between the opposed forms 10 when the forms 10 are drawn together to define the space for receiving poured concrete.

With continued reference to FIGS. 1A, 2 and 3, the exemplary form 10 further includes bracket assemblies 52 which may be coupled to the frame 12 to engage the first and second tie rod engaging portions 22, 40 whereby the brackets 52 are used in conjunction with the second tie rod engaging portions 40 to support the threaded rods 46 extending between the parallel form sections 10. The brackets 52 include bracket plates 54 having apertures 56 corresponding to the apertures 50 on plates 44 and sized to receive the threaded rods 46 therethrough. The brackets 52 further include first and second leg members 58, 60 which extend from the bracket plates 54. The first leg members 58 are configured to be received in the apertures 30 formed by the notches 24 of adjacent frame members 12 and the second leg members 60 contact the plates 44 of the second tie rod engaging portions 40. Advantageously, washers 62 and nuts 64 may be installed over the distal ends of the threaded bars 46 (only one end being shown) extending through the bracket assemblies 52, whereupon tightening of the nuts 64 draws opposing form sections 10 together until the members 18 clamp against the tubes 48.

The second type of tie rod system 42 may further include sealing cones 66 inserted in opposite ends of the tubes 48. The sealing cones 66 have annular apertures 68 through which the threaded bars 46 protrude and an enlarged portion 70 which extends radially beyond the outer diameter of the tubes 48 such that the cones 66 are compressed between the tubes 48 and members 18 when opposing wall forms 10 are drawn together. Arranged in this manner, the sealing cones 66 prevent leakage of poured concrete through the openings 19.

The second type of tie system shown in the exemplary embodiment is a type commonly used in Europe, Canada, and South America. It will be recognized by those skilled in the art, that the second tie rod engaging portions 40 illustrated herein could alternatively be used to accommodate various other types of tie systems known in the art, such as she-bolts and threaded taper ties.

The concrete form 10 described above can readily be used with various types of tie systems to create parallel sections for receiving poured concrete. In the embodiments shown and described herein, a first type of tie rod 26 may be inserted through apertures 30 defined by notches 24 in adjacent forms to extend between the parallel sections. When it is desired to utilize the second type of tie rod 42, the bracket assemblies 52 may be easily coupled to the frames 12 of the forms 10 to support the second type of tie rod 42.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A system for forming a concrete structure, comprising:

a plurality of forms configured to be secured togeather in a generally edge-to-edge arrangement and also in a spaced, confronting arrangement to define a space for receiving poured concrete therebetween:

each said form including at least one first tie rod engaging portion and at least one second tie rod engaing portion diaposed on said form, such that tie rods engaged with said first end second tie rod engaging portions extend through said space for receiving poured concrete;

said first tie rod engaging portion configured to receive a tie rod of a first type, said second tie rod engaging portion configured to receive a tie rod of a second type;

wherein the first type of tie rod is a non-removable tie rod with frangible ends, and the second type of tie rod is removable from said space;

at least one bracket couplable with one of said plurality of forms, proximate one of said second tie rod engaging portions, said bracket and said second tie rod engaging portion cooperating to support a tie rod of the second type on said frame; and wherein said bracket comprises a bracket plate and first and second leg members extending in a direction normal to said bracket plate, said first leg member configured to engage said first tie rod engaging portion, said second leg member configured to engage said second tie rod engaging portion.

2. A concrete form, comprising:

at least one form section adapted for use in combination with at least one other form section to define a space for receiving poured concrete;

at least one first tie rod engaging portion disposed on said form section and configured to receive a tie rod of a first type;

a second tie rod engaging portion disposed on said form section and configured to receive a tie rod of a second type; and at least one bracket couplable to said form section, proximate said second tie rod engaging portion, said bracket and said second tie rod engaging portion cooperating to support a tie rod of the second type on said form section;

wherein said bracket comprises a bracket plate and first and second leg members extending in a direction normal to said bracket plate, said first leg member configured to engage said first tie rod engaging portion, said second leg member configured to engage said second tie rod engaging portion.

3. A concrete form, comprising:

at least one form section adapted for use in combination with at least one other form section to define a space therebetween for receiving poured concrete;

at least one first tie rod engaging portion disposed on said form section and configured to receive a tie rod of a first type such that the first type of tie rod extends through said space for receiving poured concrete; and a second tie rod engaging portion disposed on said form section and configured to receive a tie rod of a second type, such that the second type of tie rod extends through said space for receiving poured concrete;

wherein the first type of tie rod is a non-removable tie rod with frangible ends, and the second type of tie rod is removable from said space;

at least one bracket couplable to said form section, proximate said second tie rod engaging portion, said bracket and said second tie rod engaging portion cooperating to support a tie rod of the second type on said form section; and wherein said bracket comprises a bracket plate and first and second leg members extending in a direction normal to said bracket plate, said first leg member configured to engage said first tie rod engaging portion, said second leg member configured to engage said second tie rod engaging portion.

4. The concrete form of claim 3, further comprising a frame associated with each of said form sections and wherein said first tie rod engaging portion comprises a at least one notch formed into said frame.

5. The concrete form of claim 3, further comprising a frame associated with each of said form sections and wherein said second tie rod engaging portion comprises a plate attached to said frame, said plate including an aperture formed through said plate end sized to receive a tie rod of the second type.

6. The concrete form of claim 3, wherein said first tie rod engaging portion as configured to receive a tie in the form of an elongate wire or generally flat strip.

7. The concrete form of claim 3, wherein said second tie engaging portion is configured to receive a tie in the form of a threaded bar.

8. The concrete form of claim 4, further comprising a facing member secured to said frame and defining an interface for molding an outer surface of the poured concrete.

* * * * *